US008397705B2

(12) United States Patent
DeHaan et al.

(10) Patent No.: US 8,397,705 B2
(45) Date of Patent: Mar. 19, 2013

(54) PNEUMATIC PAINTBALL MARKER

(75) Inventors: David J. DeHaan, San Diego, CA (US); Bryon E. Benini, San Marcos, CA (US); Eric L. Roberts, San Diego, CA (US); William R. Wing, San Diego, CA (US); Eero K. Kaakkola, San Diego, CA (US)

(73) Assignee: Dye Precision, Inc., San Diego, CA (US)

( * ) Notice: Subject to any disclaimer, the term of this patent is extended or adjusted under 35 U.S.C. 154(b) by 0 days.

(21) Appl. No.: 13/461,074

(22) Filed: May 1, 2012

(65) Prior Publication Data

US 2012/0210992 A1 Aug. 23, 2012

Related U.S. Application Data

(63) Continuation of application No. 12/555,723, filed on Sep. 8, 2009, now Pat. No. 8,186,338, which is a continuation of application No. 11/569,564, filed as application No. PCT/US2005/018494 on May 25, 2005, now Pat. No. 7,594,503.

(60) Provisional application No. 60/574,361, filed on May 25, 2004.

(51) Int. Cl.
*F41B 11/00* (2006.01)

(52) U.S. Cl. ..... 124/74; 124/73; 124/77

(58) Field of Classification Search ..... None
See application file for complete search history.

(56) References Cited

U.S. PATENT DOCUMENTS

| | | | | |
|---|---|---|---|---|
| 2,275,723 | A * | 3/1942 | Bregi | 82/148 |
| 2,881,752 | A | 4/1959 | Blahnik | |
| 3,204,625 | A | 9/1965 | Shepherd | |
| 4,227,508 | A | 10/1980 | D'Andrade | |
| 4,369,759 | A | 1/1983 | Gerstenberger et al. | |
| 4,644,930 | A | 2/1987 | Mainhardt | |
| 4,850,330 | A | 7/1989 | Nagayoshi | |
| 4,936,282 | A | 6/1990 | Dobbins et al. | |
| 5,063,905 | A | 11/1991 | Farrell | |
| 5,078,118 | A | 1/1992 | Perrone | |
| 5,253,873 | A | 10/1993 | Grattan | |
| 5,257,614 | A | 11/1993 | Sullivan | |
| 5,265,582 | A | 11/1993 | Bhogal | |
| 5,280,778 | A | 1/1994 | Kotsiopoulos | |
| 5,349,938 | A | 9/1994 | Farrell | |
| 5,383,442 | A | 1/1995 | Tippmann | |
| 5,505,188 | A | 4/1996 | Williams | |
| 5,509,399 | A | 4/1996 | Poor | |

(Continued)

FOREIGN PATENT DOCUMENTS

| | | |
|---|---|---|
| EP | 1 503 166 A | 2/2005 |
| GB | 2 418 007 A | 3/2006 |

(Continued)

OTHER PUBLICATIONS

International Search Report for International Application No. PCT/US2007/079583, mailed Jan. 22, 2008, 4 pages.

*Primary Examiner* — Samir Abdosh
(74) *Attorney, Agent, or Firm* — Knobbe Martens Olson & Bear LLP

(57) ABSTRACT

A novel and unique pneumatic paintball marker having a variety of novel features, the first being an on/off compressed air control valve, positioned at the front of the marker below the barrel and adjacent to an in-line pressure regulator. Major innovations have been made in reducing the size and weight of the body of the marker, along with the construction of a new bolt assembly consisting of just four components and only one moving part. An anti-chop eye electronic system insures that the paintballs are in proper position, and rubber ball detents are optionally added to hold the paintballs in place prior to firing the marker, so that the paintballs will not roll out the barrel.

20 Claims, 10 Drawing Sheets

U.S. PATENT DOCUMENTS

| | | | | |
|---|---|---|---|---|
| 5,572,982 | A * | 11/1996 | Williams | 124/74 |
| 5,613,483 | A * | 3/1997 | Lukas et al. | 124/73 |
| 5,727,538 | A | 3/1998 | Ellis | |
| 5,950,611 | A | 9/1999 | Lopez et al. | |
| 6,035,843 | A | 3/2000 | Smith et al. | |
| 6,142,137 | A | 11/2000 | MacLaughlin | |
| 6,405,722 | B2 * | 6/2002 | Colby | 124/74 |
| 6,516,791 | B2 | 2/2003 | Perrone | |
| 6,520,172 | B2 | 2/2003 | Perrone | |
| 6,532,949 | B1 | 3/2003 | McKendrick | |
| 6,590,386 | B1 | 7/2003 | Williams | |
| 6,644,295 | B2 | 11/2003 | Jones | |
| 6,708,685 | B2 * | 3/2004 | Masse | 124/75 |
| 6,807,959 | B1 | 10/2004 | Murdock et al. | |
| 6,889,682 | B2 | 5/2005 | Styles et al. | |
| 6,966,313 | B1 | 11/2005 | Yokota et al. | |
| 7,107,981 | B1 | 9/2006 | Dunn | |
| 7,159,585 | B2 | 1/2007 | Quinn et al. | |
| 7,185,646 | B2 | 3/2007 | Jones | |
| 7,237,544 | B2 | 7/2007 | Jones | |
| 7,347,220 | B2 | 3/2008 | Carpenter et al. | |
| 7,395,819 | B2 | 7/2008 | Dobbins et al. | |
| 7,434,573 | B2 | 10/2008 | Orr | |
| 7,594,503 | B2 * | 9/2009 | DeHaan et al. | 124/74 |
| 7,640,923 | B1 | 1/2010 | Chen | |
| 7,882,830 | B1 | 2/2011 | Gabrel | |
| 2002/0088449 | A1 | 7/2002 | Perrone | |
| 2003/0005918 | A1 * | 1/2003 | Jones | 124/70 |
| 2003/0047175 | A1 * | 3/2003 | Farrell | 124/76 |
| 2003/0131834 | A1 | 7/2003 | Rice et al. | |
| 2003/0168052 | A1 * | 9/2003 | Masse | 124/73 |
| 2004/0084040 | A1 | 5/2004 | Jones | |
| 2004/0154600 | A1 | 8/2004 | Jong | |
| 2004/0200467 | A1 | 10/2004 | Tiberius | |
| 2004/0216728 | A1 | 11/2004 | Jong | |
| 2004/0237954 | A1 * | 12/2004 | Styles et al. | 124/77 |
| 2005/0011507 | A1 | 1/2005 | Webb | |
| 2005/0115550 | A1 * | 6/2005 | Jones | 124/65 |
| 2005/0115554 | A1 | 6/2005 | Jones | |
| 2005/0133014 | A1 * | 6/2005 | Jones | 124/73 |
| 2005/0188973 | A1 | 9/2005 | Monks | |
| 2005/0217655 | A1 | 10/2005 | Jones | |
| 2006/0005822 | A1 * | 1/2006 | Quinn et al. | 124/73 |
| 2006/0011188 | A1 | 1/2006 | Jones | |
| 2006/0042616 | A1 | 3/2006 | Orr | |
| 2006/0207587 | A1 | 9/2006 | Jones et al. | |
| 2007/0062509 | A1 | 3/2007 | Campo et al. | |
| 2007/0068502 | A1 * | 3/2007 | Jones et al. | 124/77 |
| 2007/0119988 | A1 | 5/2007 | Sheng | |
| 2007/0163661 | A1 * | 7/2007 | Carpenter et al. | 137/625.25 |
| 2007/0181117 | A1 | 8/2007 | Tippmann et al. | |
| 2007/0186916 | A1 | 8/2007 | Jones | |
| 2007/0209650 | A1 | 9/2007 | Jones | |
| 2007/0267005 | A1 | 11/2007 | Yeh | |
| 2008/0078370 | A1 | 4/2008 | Kaakkola et al. | |
| 2008/0099005 | A1 | 5/2008 | Kaakkola et al. | |
| 2008/0105245 | A1 * | 5/2008 | Cole | 124/77 |
| 2008/0245351 | A1 * | 10/2008 | Kaakkola et al. | 124/74 |
| 2008/0264399 | A1 | 10/2008 | Dobbins et al. | |
| 2009/0064981 | A1 | 3/2009 | Dobbins et al. | |
| 2010/0051007 | A1 | 3/2010 | Telford et al. | |
| 2010/0154766 | A1 | 6/2010 | Skilling | |

FOREIGN PATENT DOCUMENTS

| | | | |
|---|---|---|---|
| WO | WO 2005/033612 | A1 | 8/2004 |
| WO | WO 2005/080905 | A2 | 9/2005 |
| WO | WO 2006/073479 | A2 | 7/2006 |
| WO | WO 2008/039865 | A1 | 4/2008 |

* cited by examiner

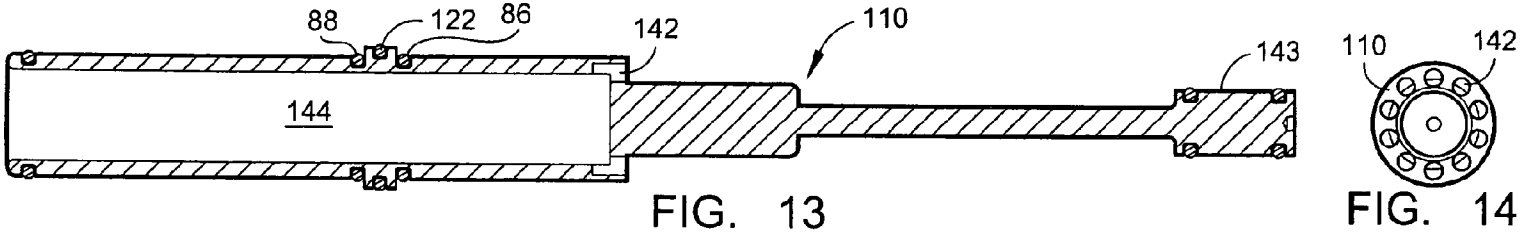
FIG. 13
FIG. 14
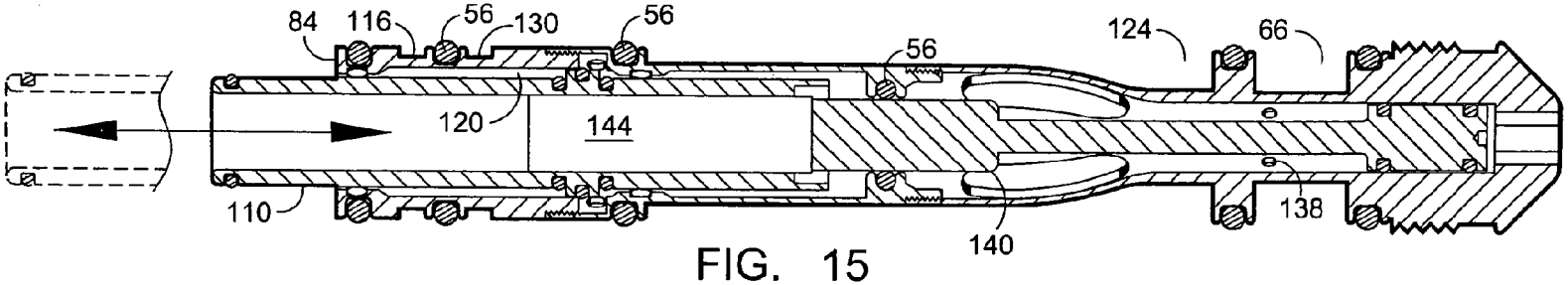
FIG. 15

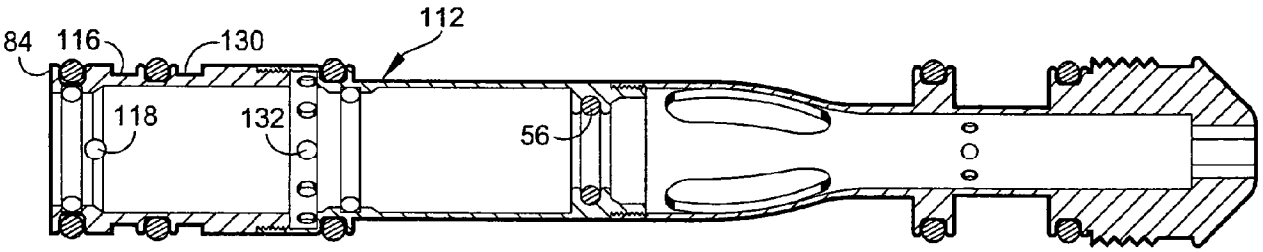
FIG. 16
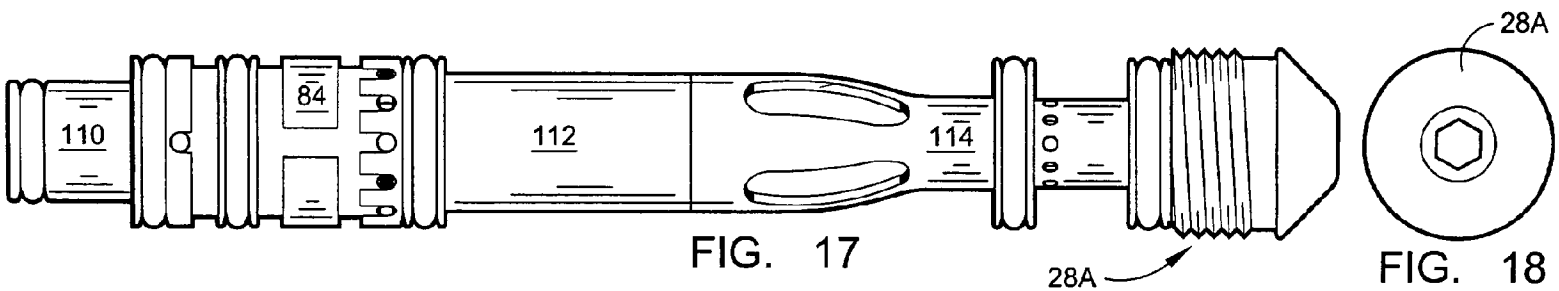
FIG. 17
FIG. 18

PNEUMATIC PAINTBALL MARKER

RELATED APPLICATIONS

This application is a continuation of co-pending application Ser. No. 12/555,723, filed Sep. 8, 2009, which is a divisional of application Ser. No. 11/569,564, filed Nov. 22, 2006, which is the U.S. national phase under 35 U.S.C. §371 of prior PCT International Application No. PCT/US05/18494, filed May 25, 2005, which claims the benefit of U.S. Provisional Patent Application No. 60/574,361 filed May 25, 2004, all of which is expressly incorporated by reference in their entireties.

TECHNICAL FIELD

The present invention relates to paintball markers. More specifically, this invention relates to improvements to the internal mechanisms of a pneumatic paintball marker.

BACKGROUND ART

This invention relates to pneumatic paintball markers, which typically are used for target practice and in mock war games and which use a compressed gas, such as air or nitrogen, to propel spherical projectiles called paintballs out of the barrel of the device. Paintballs are typically comprised of a colored liquid enclosed in a fragile gelatin casing. The paintballs are designed to rupture upon impact to mark the target.

Initially, the pneumatic paintball markers were used to mark trees and inaccessible objects for removal or identification. The use of the markers have further developed into the sport known as "Paintball" in which the spherical projectiles containing colored liquid are fired at an opponent and burst upon contact, so that the colored liquid is deposited on the opponent scoring a hit for the combatant. All the participants involved in the sport are required to wear an abundance of protective gear, so that the paintballs can hit no vital part of the player's anatomy.

The sport of paintball has become very popular within a relatively short period of time in the United States and Canada, but there is still a need for a pneumatic paintball marker with improved features including firing capabilities that more accurately controls the burst of the gas that fires a paintball from the barrel of the marker, and that is lighter and easier to handle. Prior art in the field of pneumatic paintball markers has produced cumbersome heavy devices machined in a square box-like configuration that fires slowly and tend to be very inaccurate. They are also prone to breaking the paintballs within the mechanism, a phenomenon called paint chopping.

The prior art paintball markers suffer from a similar problem, in that paintballs may vary in size to a slight degree depending upon the manufacturer, so that with paintballs that are smaller in diameter, they will have a tendency to fall out of the marker when it is pointed in a downward direction.

SUMMARY OF THE INVENTION

Before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

The invention is defined by the appended claims with the specific embodiments shown in the attached drawings. Briefly stated, the present invention contemplates a novel and unique pneumatic paintball marker with a variety of novel features.

To activate or de-activate the pneumatic paintball marker the operator win press the on or off button on the membrane panel at the back of the handgrip frame. Power is supplied to the device by a nine-volt battery housed along with the printed circuit board within the handgrip frame.

The pneumatic paintball marker consists of a device where compressed air or nitrogen gas is supplied to the pneumatic paintball marker by the means of a conventional in-line pressure regulator. It must be understood at this time that a wide variety of compressed gasses will work equally well within the pneumatic paintball marker as well as compressed air and all will be covered within the scope of this patent, although references within this patent will be made to compressed air only. The in-line pressure regulator threads into the in-line pressure regulator adapter that is attached at the front of the body of the pneumatic paintball marker below the on/off compressed air control valve. The output pressure of the in-line pressure regulator is adjusted by turning the brass air regulating screw located up inside the base of the in-line pressure regulator. By turning the brass air regulating screw counter-clockwise, you will increase the output pressure of the in-line pressure regulator to the pneumatic paintball marker. By turning the brass air regulating screw clockwise, you will decrease the output pressure of the in-line pressure regulator.

A unique on/off compressed air control valve is located under the barrel at the front of the pneumatic paintball marker above and adjacent to the in-line pressure regulator adapter. To turn the compressed air on, the valve will be rotated in a counter-clockwise direction, and to turn the compressed air off, the valve will be rotated in a clockwise direction. The on/off compressed air control valve has a positive stop in both directions. All air will vent the forward portion of the pneumatic paintball marker when the valve is turned off through the down stream exhaust hole. Some gas may still be present in the low-pressure regulator and solenoid after the gas has been vented from the marker by the on/off compressed air control valve.

The primary element of this pneumatic paintball marker and most of the previous prior art markers is the design of the bolt assembly. The conventional prior art design makes use of eight components; a front wall, the cylinder, the bolt, the top hat, a spacer tube, a bolt stop, the rear wall, and the rear cap.

The pneumatic paintball marker bolt assembly disclosed within this patent uses a unique design with the end result having only one moving part, the bolt, with the complete bolt assembly comprised of only four components; the bolt, the cylinder, the top hat and the rear cap.

Air is supplied to the bolt assembly at two points. A high-pressure supply of air routed to the back of the bolt assembly into the bolt recharging chamber. This high-pressure air source is responsible for propelling the paintball. Low-pressure air is supplied from the low-pressure regulator to the solenoid. From the solenoid, the air is optionally routed through two small holes to the section of the bolt assembly referred to as the cylinder. When the pneumatic paintball marker is aired up, air is transferred by the solenoid to the front of the cylinder. This air pushes against the bolt sail and the bolt is held in the back position. When the bolt is held back, the 0-ring in the top hat substantially seals around the bolt and contains the air in the supply chamber.

When the marker is fired, the micro switch is pressed, telling the solenoid to switch the flow of air from the front of the cylinder to the rear of the cylinder. Air that enters the rear of the cylinder will push on the bolt sail, moving the bolt forward. The air in the front of the cylinder is vented back through the solenoid.

As the bolt moves forward, the tapered stem passes through the top hat. Once the bolt stem can no longer substantially seal against the o-ring, the air contained in the bolt's main air chamber is released through the air channel between the bolt and the top hat. The air passes through the air transfer orifices in the bolt and out the front of the bolt to propel the paintball. When the bolt is in the forward position, the inside rear bolt stem o-ring prevents the air from continuously flowing through the marker when the bolt is forward. This helps the marker shoot much more efficiently and accurately.

An alternate embodiment on the rear cap of the bolt assembly will incorporate a quick removal system for the bolt assembly. This bolt assembly will have two cogs for a quarter-turn locking mechanism instead of the threads for locking the bolt within the marker body. The two cogs will be inserted into two matching retainers at the rear of the marker body. The rear cap will also incorporate a spring-loaded ball detent that will drop into a depression within the central bore of the marker body with a button on the outside surface of the marker body to push the ball detent back for removal of the bolt assembly The low-pressure regulator is located in the lower back of the pneumatic paintball marker below the orifice containing the bolt assembly. The function of the low-pressure regulator is to decrease the air pressure supplied to the marker by the in-line high-pressure source before it reaches the solenoid. This low-pressure air is used to move the bolt forward and back. You can fine-tune the pneumatic paintball marker to its minimum cycle pressure by adjusting the low-pressure regulator. This will reduce the amount of force of the bolt hitting the ball thus reducing paintball breaks also helping with efficiency. Too low air pressure from the low-pressure regulator will cause the bolt to not cycle and move sluggishly or not move at alt. Too high of air pressure from the low-pressure regulator will cause the marker not to shoot as smoothly, potentially increasing paintball breakage, causing undue wear and fatigue on the bolt components.

Turning the adjustment screw on the low-pressure regulator on the back of the pneumatic paintball marker clockwise, or in, will decrease the low-pressure regulator's output. Turning the adjustment screw counter-clockwise, or out, will raise the low-pressure regulator's output.

The anti-chop eye system will prevent the pneumatic paintball marker from breaking the paintballs within the marker which is commonly called, chopping paint, by not allowing the marker to fire until a paintball is fully seated in front of the bolt. The anti-chop eyes use a beam across the barrel cavity to identify the paintball location. On one side there is a transmitter, and on the opposite side a receiver. In order for the marker to fire with the anti-chop eyes turned on the beam between the transmitter eye and the receiver eye must be broken. After every shot, before the next paintball drops in the breech, the transmitter and receiver must recognize each other. If the eyes are dirty and cannot see each other between shots, the anti-chop indicator lamp on the circuit board that can be seen through the lens in the hand grip will start blinking green. This means that the anti-chop eyes are dirty. This is an extremely reliable system as long as the anti-chop eyes are kept clean. The most common reason for dirty anti-chop eyes is broken paintballs within the marker. If the anti-chop eyes become dirty the marker will automatically default to a reduced rate of fire to prevent chopping. Ball detents on either side of the barrel restrain the paintballs in position between the anti-chop eyes of the transmitter and the receiver prior to the firing of the pneumatic paint ball marker. Additionally, ball detents act to prevent: (1) "double feeding" a paintball; (2) a paintball from rolling down the breech; and (3) allowing a second paintball to fully or partially feed into the breech.

This system works very well as long as the detector part does not see any other source of light containing the wavelength used by the transmitter. The main problem is direct sunlight because it contains the full spectrum of light and is very intense. To solve the problem caused by the sun the paintball marker will modulate the output of the transmitter by turning it on and off in a fast pace, then it will read this signal from the receiver with the onboard software. This enables the device to be sure that the signal the receiver is receiving is actually the one it is sending with the transmitter. This is very valuable information, since if the receiver sees sun light instead of the emitter, it thinks that there is no paintball chambered inside the barrel and it will not allow the marker to fire. This system does not enable the device to have the anti-chop eye functioning in direct sun light since the receiver will see a signal all the time and cannot work properly, but it enables the pneumatic paintball marker to report the error by the means of a blinking indicator light in grip visible to the user and the device will bypass the anti-chop eye system until it starts functioning again.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is a general advantage of this invention to improve the internal mechanisms of the pneumatic paintball marker.

Another advantage of this invention is to create a unitary marker body that has a futuristic modem compact design with a plurality of internal channels minimizing the number of parts incorporated within the device.

Another advantage of this invention is to design a pneumatic paintball marker with the on/off compressed air control valve below the barrel at the front of the marker and adjacent to the in-line pressure regulator.

Another advantage of this invention is to design a pneumatic paintball marker that wilt automatically recognize that a paintball is in position with an anti-chop electronic eye system prior to firing.

Yet another advantage of this invention is to design a pneumatic paintball marker with a pair of ball detents in the barrel to restrain the paintball in position prior to firing, thereby preventing double feeding of paintballs.

Another advantage of this invention is to increase the speed with which the pneumatic paintball marker will fire.

A further advantage of this invention is to design a pneumatic paintball marker with a bolt assembly that is lightweight and consisting of only four parts.

Yet a further advantage of this invention is to make the pneumatic paintball marker as lightweight as possible and operate smooth and fast along with improving the accuracy.

It is therefore a principal advantage of the invention to provide a pneumatic paintball marker with more refined external features and compact and efficient internal mechanisms for an improved firing gas control system.

The foregoing has outlined some of the more pertinent advantages of the invention. These objects should be construed to be merely illustrative of some of the features and applications of the intended invention. Many other beneficial results can be attained by applying the disclosed invention in a different manner or by modifying the invention within the scope of the disclosure. Accordingly, other advantages and a fuller understanding of the invention may be had by referring to the summary of the invention and the detailed description of the embodiments herein, in addition to the scope of the invention defined by the claims taken in conjunction with the accompanying drawings.

BRIEF DESCRIPTION OF DRAWINGS

The accompanying drawings, which are incorporated in and form a part of this specification, illustrate embodiments of the invention and together with the description, serve to explain the principles of this invention.

FIG. 13 is a cross-section through the bolt.

FIG. 14 is an end view of the bolt.

FIG. 15 is a cross-section through the bolt assembly illustrating the translating action of the bolt.

FIG. 16 is a cross-section through the cylinder, the top hat and the rear cap of the bolt assembly.

FIG. 17 is a side view of the bolt assembly.

FIG. 18 is an end view of the bolt assembly.

DETAILED DESCRIPTION OF CERTAIN EMBODIMENTS

Figure 1:
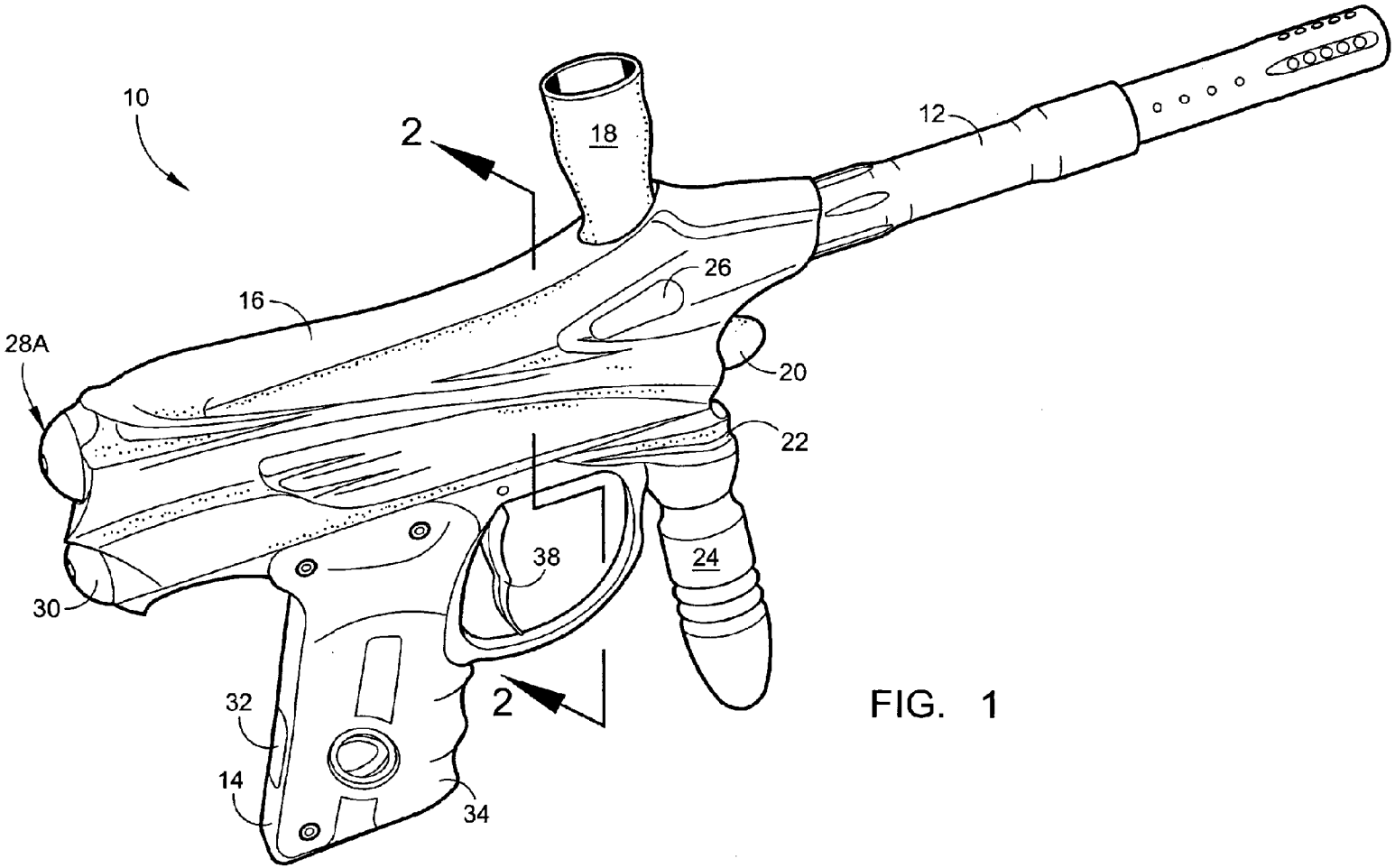
FIG. 1 depicts a perspective view of an embodiment of the pneumatic paintball marker.

Referring now to the drawings, wherein similar parts of certain embodiments of the invention are identified by like reference numerals, there is seen in FIG. 1 a perspective view of the pneumatic paintball marker 10 depicting the primary external elements of the one embodiment of the invention. The description of the pneumatic paintball marker 10 is shown with an individual holding the pneumatic paintball marker 10 in the right hand pointing it forward indicating the right side as the right, and left side as the left of the individual holding the device, with the barrel 12 being the front and the handgrip frame 14 being the back. The barrel 12 threads into the front of the body 16 of the pneumatic paintball marker 10 with the paintball loading chamber 18 at the top, which may comprise an adjustable feed neck to fit paintball loaders of different dimensions.

Figure 2:
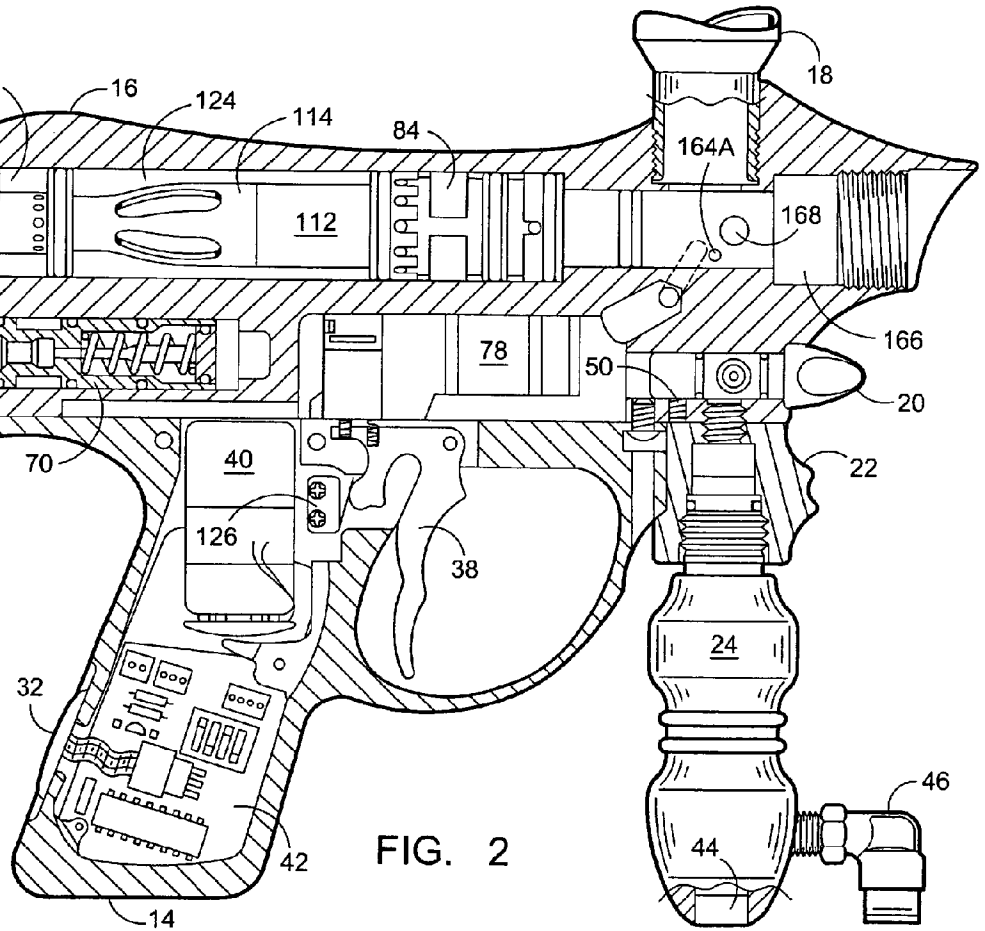
FIG. 2 is a cross-section through the center of the pneumatic paintball marker of FIG. 1 showing the right side.
Figure 2A:
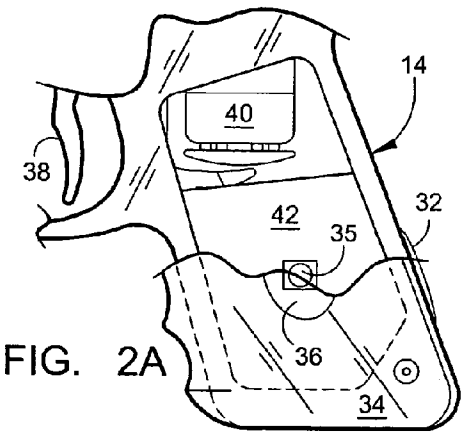
FIG. 2A is a side view of the left side of the handgrip shown in FIG. 2, with the handgrip cover partially cut away.

The unique on/off compressed air control valve 20 (described in greater detail below) is below the barrel 12 at the front of the pneumatic paintball marker 10 adjacent to the in-line pressure regulator adapter 22. The conventional in-line pressure regulator 24 threads into the in-line pressure regulator adapter 22. On either side of the body 16 are the anti-chop eye system cover plates 26. At the back of the body 16 is the bolt assembly 28A and the low-pressure regulator threaded cap 30. As shown in FIG. 2A, the hand grip frame 14 houses the electronics of the device with the membrane panel 32 incorporating the on and off electronics switches along with the trigger mechanism 38. The handgrip frame 14 is enclosed on the sides and the front by the urethane grip cover 34 with the anti-chop indicator lamp 35 and anti-chop indicator lamp lens 36 on the left side of the pneumatic paintball marker 10.

The body 16 is generally gun-shaped, and in one embodiment is manufactured as a single metal piece with a computer numerically controlled ("CNC") machine.

To activate or de-activate the pneumatic paintball marker 10 the operator will press the on or off button on the membrane panel 32 at the back of the handgrip frame 14. Power is supplied to the pneumatic paintball marker 10 by a nine-volt battery 40 housed along with the printed circuit board 42 within the handgrip frame 14 depicted in FIG. 2.

Membrane panel 32 may have a variety of shapes, such as a sculpted shape, both to improve the grip of the user and for aesthetic reasons. Membrane panel 32 may also be made of an anti-slip material, and have waterproofing properties that protect frame 14 and its contents.

The pneumatic paintball marker 10 consists of a device where compressed air or nitrogen gas is supplied to the pneumatic paintball marker 10 by the means of a conventional in-line pressure regulator 24. It must be understood at this time that a wide variety of compressed gasses will work equally well within the pneumatic paintball marker 10 as well as compressed air and all will be covered within the scope of this patent, although references within this patent wilt be made to compressed air only. The in-line pressure regulator 24 threads into the in-line pressure regulator adapter 22 that is attached at the front of the body 16 of the pneumatic paintball marker 10 below the on/off compressed air control valve 20. The output pressure of the in-line pressure regulator 24 is adjusted by turning the brass air regulating screw 44 located up inside the base of the in-line pressure regulator 24. By turning the brass air regulating screw 44 counter-clockwise, a user will increase the output pressure of the in-line pressure regulator 24 to the pneumatic paintball marker 10. By turning the brass air regulating screw 44 clockwise, the user will decrease the output pressure of the in-line pressure regulator 24 to the pneumatic paintball marker 10. High-pressure compressed air is supplied to the in-line pressure regulator 24 at the air fitting 46 at the base. In one embodiment, the in-line pressure regulator 24 adjusts the pressure of the compressed gas within a 350-3100 kPa range.

Figure 3:
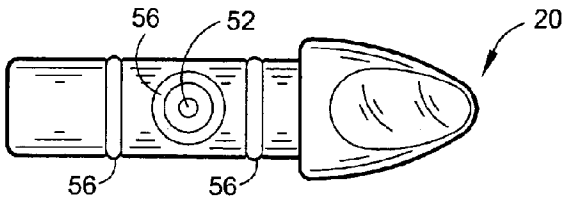
FIG. 3 is a top view of the on/off compressed air control valve.
Figure 4:
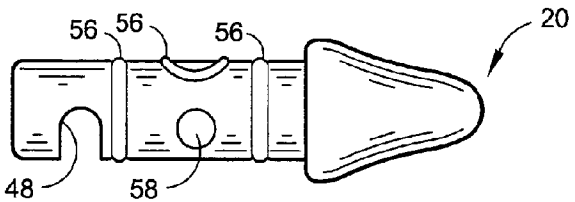
FIG. 4 is a side view of the on/off compressed air control valve.
Figure 5:
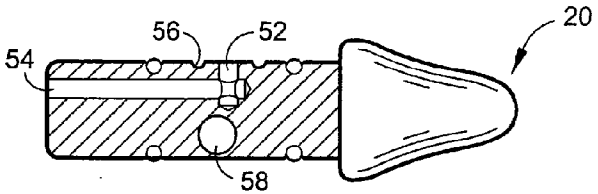
FIG. 5 is a cross-section through the on/off compressed air control valve.
Figure 9:
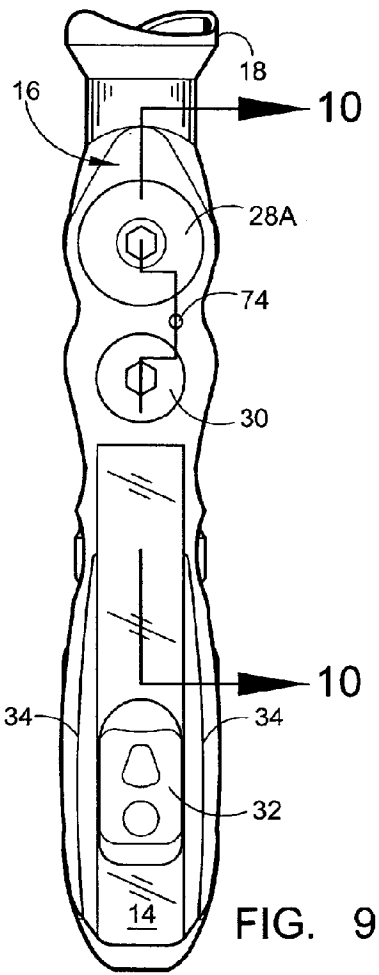
FIG. 9 is a rear view of the pneumatic paintball marker.
Figure 6:
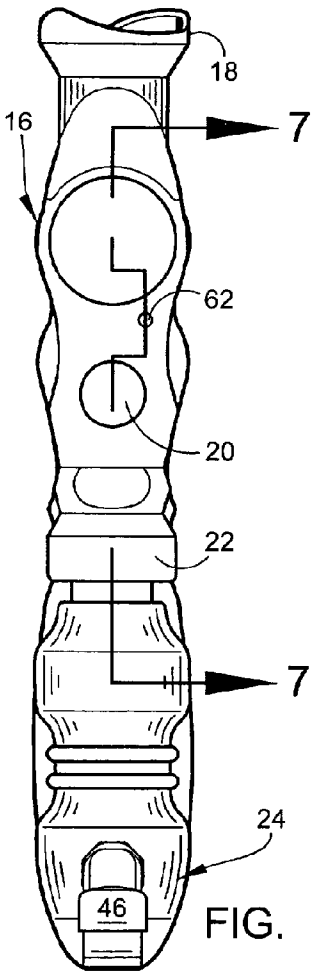
FIG. 6 is a front-end view of the pneumatic paintball marker of FIG. 1.
Figure 7:
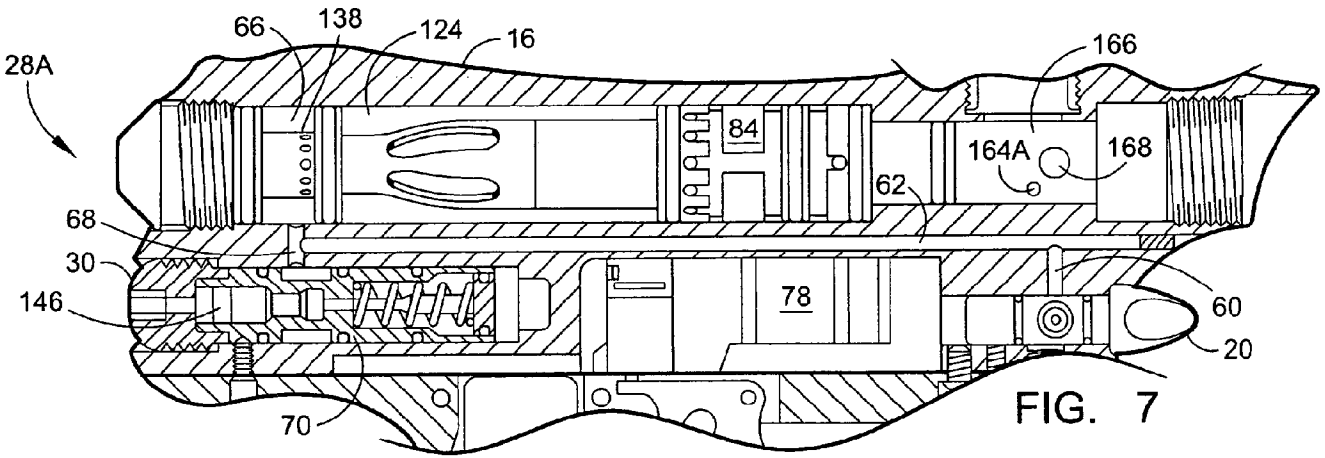
FIG. 7 is a cross-section through the pneumatic paintball marker of FIG. 1 showing the right side and illustrating the high-pressure air supply passage.
Figure 10:
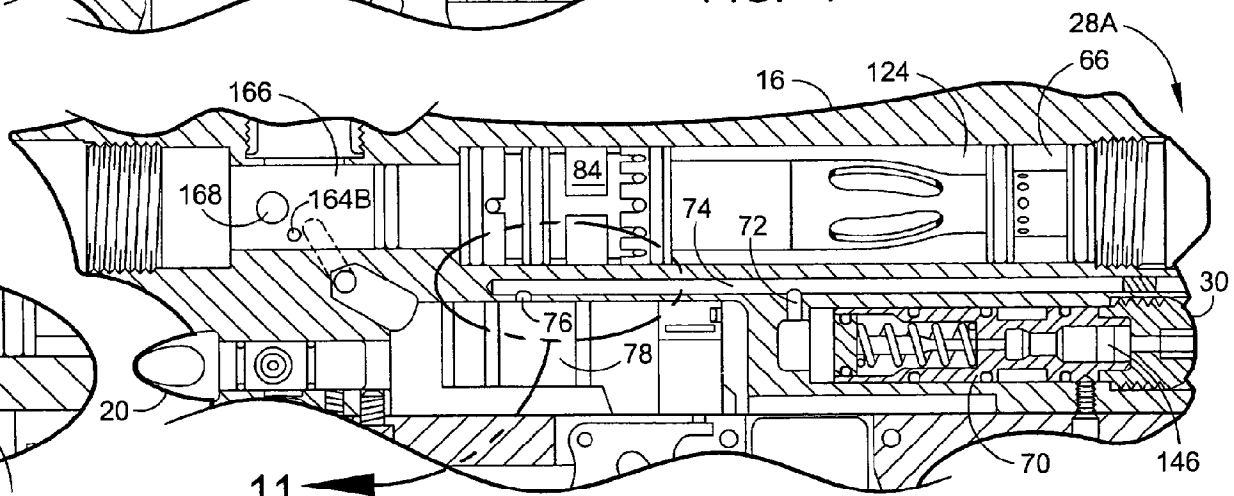
FIG. 10 is a cross-section through the pneumatic paintball marker of FIG. 1 showing the left side and illustrating the low-pressure air transfer passage.
Figure 8:
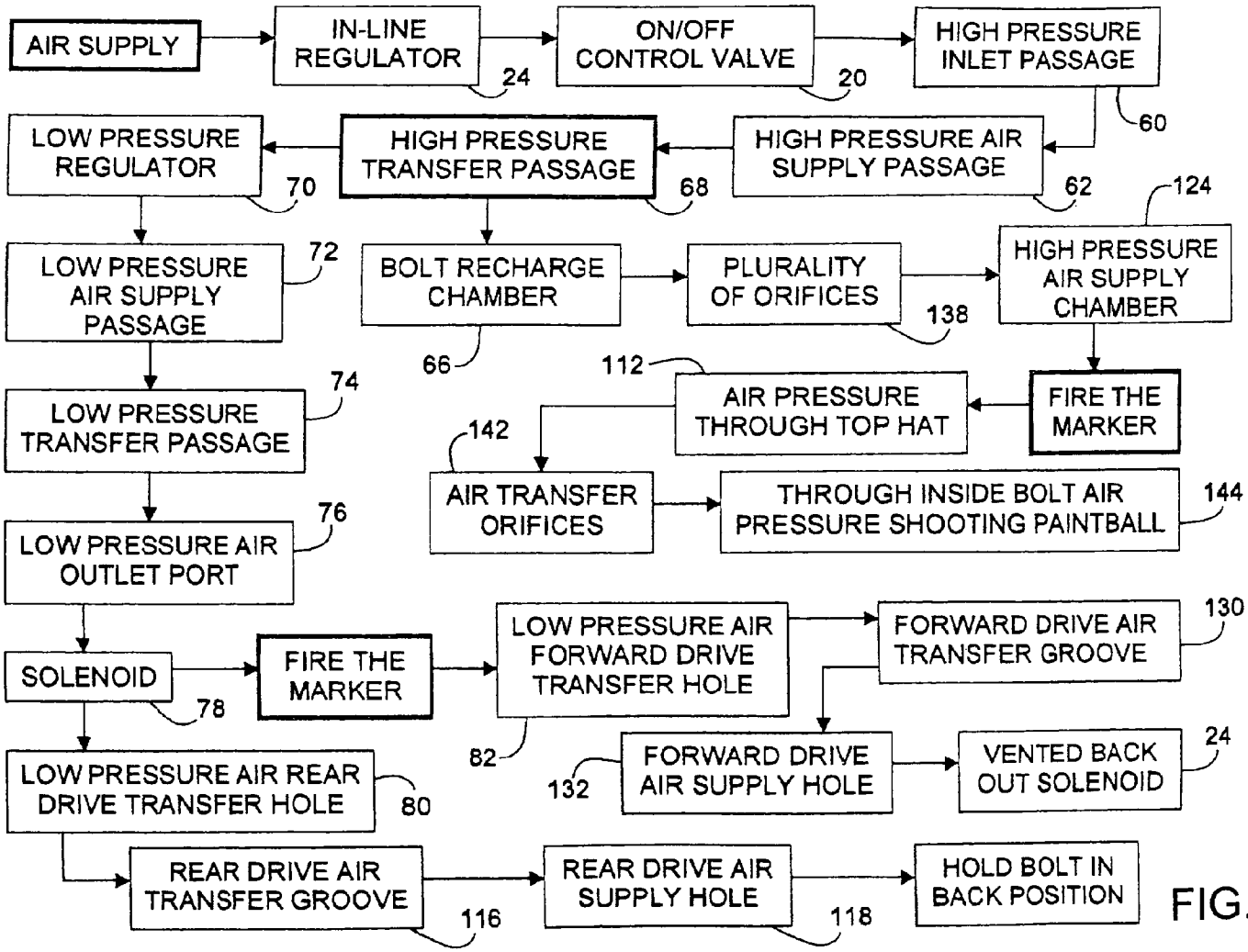
FIG. 8 is a block diagram describing the air movement through the pneumatic paintball marker.

A unique on/off compressed air control valve 20 depicted in FIGS. 3, 4, and 5 is located under the barrel 12 at the front of the pneumatic paintball marker 10 above and adjacent to the in-line pressure regulator adapter 22. To turn the compressed air on, the on/off compressed air control valve 20 will be rotated in a counter-clockwise direction, and to turn the gas off, the on/off compressed air control valve 20 will be rotated in a clockwise direction. The on/off compressed air control valve 20 has a positive stop cavity 48 where a setscrew 50 may be introduced to limit the travel of the on/off compressed air control valve 20 in both directions. All air will vent the forward portion of the pneumatic paintball marker 10 when the valve is turned off through the down stream exhaust hole 52 to the exhaust passage 54. A wide variety of sizes and shapes of conventional o-rings have been used throughout the pneumatic paintball marker 10 and all will be given the identifying numeral 56. The substantial sealing of the on/off compressed air control valve 20 is made by the means of conventional o-rings 56. A through air passage 58 in the on/off compressed air control valve 20 allows the compressed air to pass through into the high-pressure inlet passage 60 then to the high-pressure air supply passage 62, which are shown in FIG. 7. Section 7-7 in the front view of the body 16 of the pneumatic paintball marker 10 shown in FIG. 6 endeavors to illustrate the offset location from the centerline of the device of the high-pressure air supply passage 62, clarified in the partial section of the pneumatic paintball marker 10 shown in FIG. 7. Additional clarification of the passage of both high-pressure air and low-pressure air through the pneumatic paintball marker 10 is made in the block diagram shown in FIG. 8 and is described in detail below. Further clarification of the low-pressure air transfer passage 74 through the body 16 of the pneumatic paintball marker 10 is shown in FIG. 9, depicting the rear view of the body 16 showing the offset location of the low-pressure air transfer passage 74, and in section 10-10, shown partially in FIG. 10. Some gas may still be present in the low-pressure regulator 70 and solenoid 78 after the gas has been vented from the marker by the on/off compressed air control valve 20.

Figure 11:
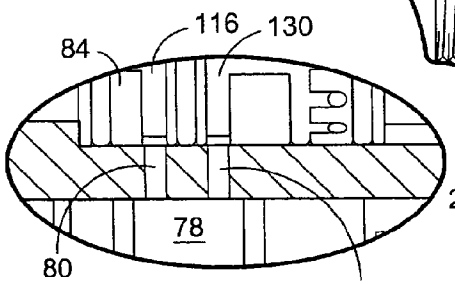
FIG. 11 is a partial section through the pneumatic paintball marker of FIG. 1 illustrating the rear drive air port and the front drive air port from the solenoid to the cylinder.

The pneumatic paintball marker 10 uses a unique design comprising only one moving part, namely, the bolt 110 (shown in FIG. 12) located within bolt assembly 28A. Air is supplied to the bolt assembly 28A at two points. A high-pressure supply of air is routed to the back of the bolt assembly 28A through the high-pressure air supply passage 62 into the bolt-recharging chamber 66 through the high-pressure transfer passage 68. This is clarified through FIGS. 7, 9, and 10. The high-pressure air source is responsible for propelling the paintball out of the barrel 12. Low-pressure air is supplied from the low-pressure regulator 70 by the means of the air traveling through the low-pressure air supply passage 72 into the low-pressure air transfer passage 74 and from there to the low-pressure outlet port 76 and into to the solenoid 78. From the solenoid 78, the air is routed through two small low-pressure air transfer holes 80 and 82 to the section of the bolt assembly referred to as the cylinder 84 illustrated in FIG. 11. For clarification of FIG. 10 the air transfer holes 80 and 82 are adjacent to the low-pressure air transfer hole 74 but do not intersect, they are connecting the solenoid 78 to the cylinder 84. The use of air transfer holes 80 and 82 for direct transfer of gas from the solenoid is an improvement over the prior art, where a manifold was instead attached to the solenoid.

Figure 12:
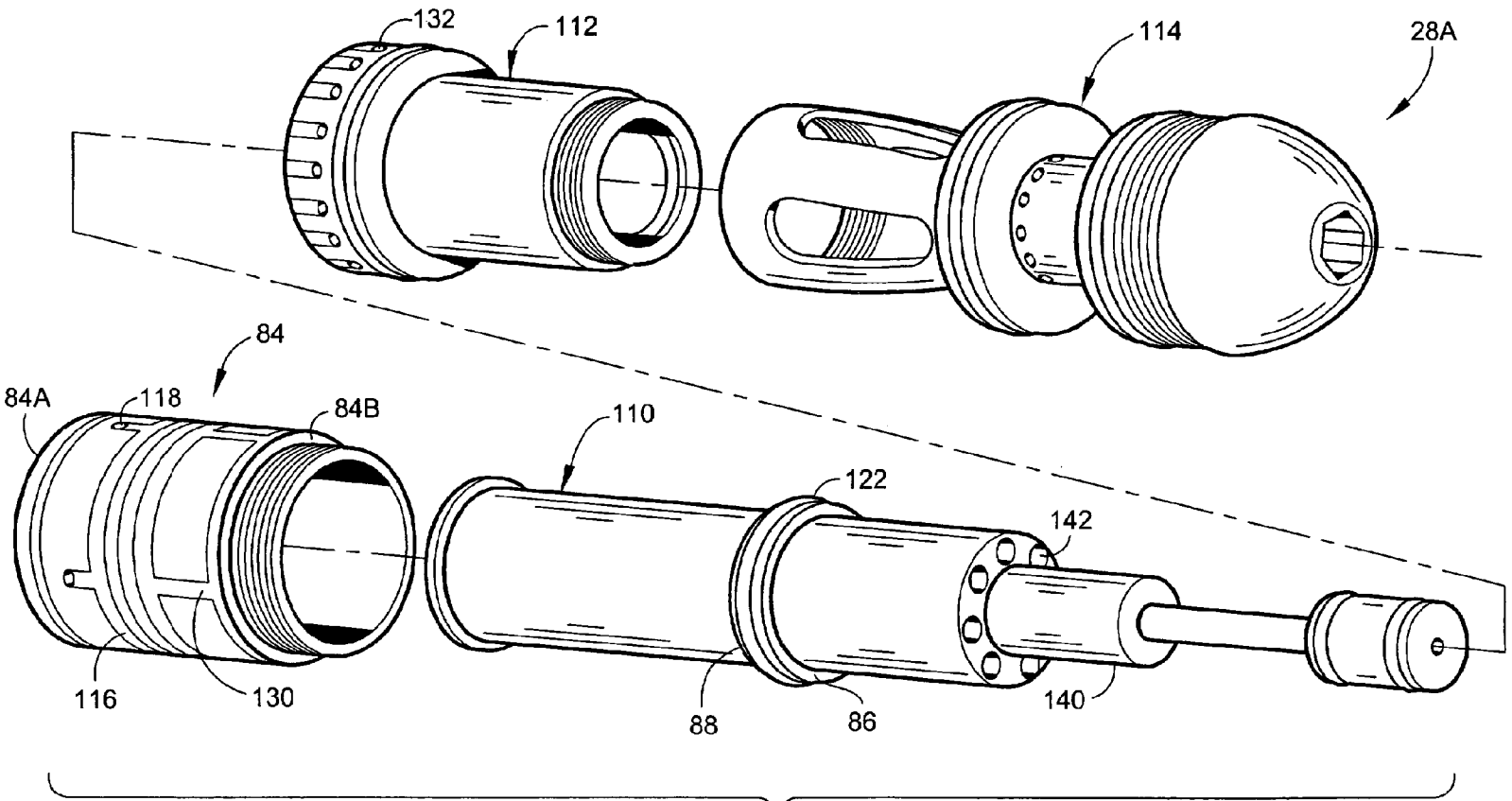
FIG. 12 is an exploded view of a bolt assembly according to one embodiment of the present invention.

In pneumatic paintball marker 10, a new and unique design was created for the bolt assembly 28A consisting of only four parts; the cylinder 84, the bolt 110, the top hat 112, and the rear cap 114, illustrated in FIG. 12. The cylinder 84 is positioned closest to the barrel 12; the rear cap 114 is positioned instead opposite to the barrel 12; and the top hat 112 is positioned in between. These four parts may be joined to each other is a variety of ways; for example, they may be joined with a threaded connection, preferably with a connection having four lead threads for a quick lock.

Additional clarification of the bolt assembly 28A is made in FIGS. 13 through 20. As low pressure air is introduced into the pneumatic paintball marker 10, air is transferred by the solenoid 78 to the front of the cylinder 84A by the means of low-pressure air traveling through the low-pressure air transfer hole 80 into the rear drive air transfer groove 116 and down the rear drive air supply hole 118 into the rear drive chamber 120. This air pushes against the bolt sail 122 providing a restraining pneumatic pressure, and the bolt 110 is held in the back position and cannot translate forward. When the bolt 110 is held back, the o-ring S6 in the top hat 112 substantially seals around the bolt 110 and contains the high-pressure air in the high-pressure air supply chamber 124.

Figure 19:
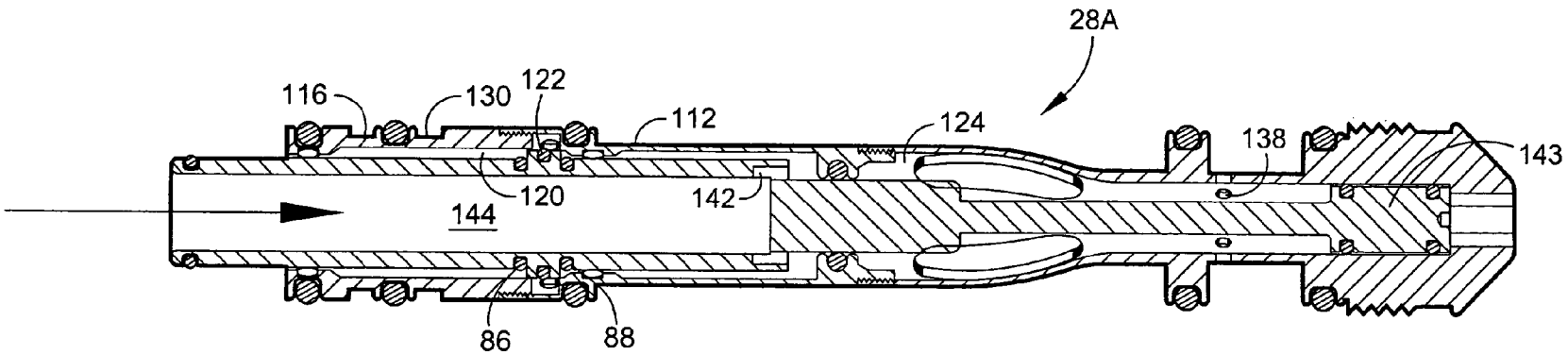
FIG. 19 is a cross-section through the bolt assembly with the bolt in the retracted position prior to firing the device.
Figure 20:
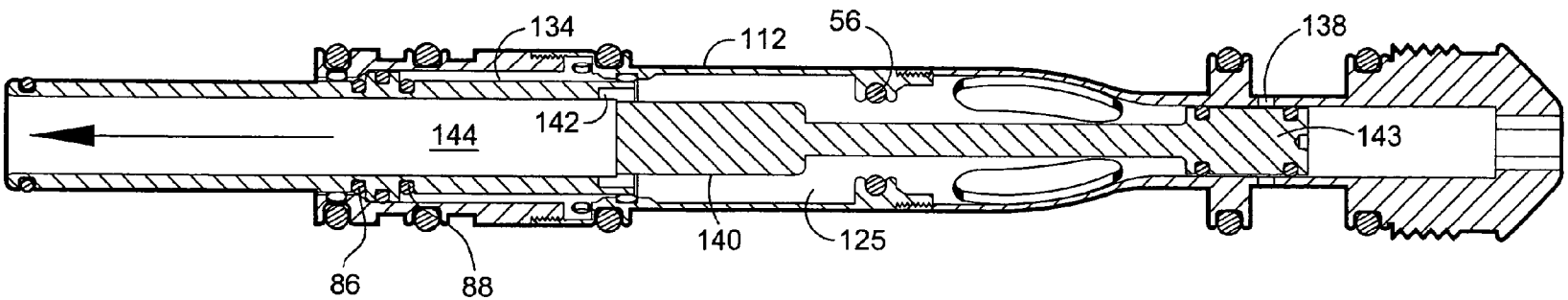
FIG. 20 is a cross-section through the bolt assembly with the bolt in the extended position at the firing of the device.

Referring more particularly to FIGS. 12 and 13, and to operational FIGS. 19 and 20, the function of the forward and rearward travel stop bumpers 86 and 88, respectively, are to cushion the impact of the bolt when the bolt translates hitting the forward and rear bolt stops, which are lesser diameter rims located at the front of the cylinder 84A and the back of the cylinder 84B.

The forward travel stop bumper 86 prevents the bolt from bouncing off the face of the forward bolt stop at the front of the cylinder 84A. When the forward travel stop bumper 86 is not present the bolt impacts the forward bolt stop, so hard that is bounces back off the face of the bolt stop. When the gun is fired, this bolt bounce interferes with the forward flow of air, and out through the front of the bolt. This disruption in optimal airflow prevents the ball from being accelerated as efficiently as possible. To compensate for this, the input pressure must be raised so that more air is used to achieve the desired ball velocity. The rise in pressure and increase in air consumption lowers the gun's air efficiency, and the gun is capable of fewer fired shots per tank of compressed air.

By incorporating the forward travel stop bumper 86 into the bolt design one is able to consistently achieve optimal airflow through the bolt when the gun is fired. This helps to greatly decrease air consumption during marker firing operations. Eliminating the need to operate the gun at such a high operating pressure provided for another performance increase. When the gun is fired the lower operating pressure causes less distortion of the shape of the paintball as it travels down the barrel, resulting in a more accurate shot.

The forward, and rear travel stop bumpers 86 and 88 respectively, also eliminate a significant amount of shock when the bolt slams against each stop. This shock is felt as a recoil, or kick, by the shooter. This recoil makes it significantly harder to hold the gun on target during high rates of fire. The end result of the major reduction of kick in this embodiment of the invention is that the gun becomes more user friendly, much easier to hold on target and easier to shoot accurately. Therefore, a pneumatic paintball marker which incorporates forward and/or rearward travel stop bumper means results in an more efficient use of compressed air and a more accurate, user friendly device.

The more efficient operation of the bolt in certain embodiments of the present invention provides for a bolt of a smaller diameter compared to the prior art (typically, 2.5 cm instead of 3 cm), and of lesser weight (typically, 100 g instead of 185 g), without loss of performance or strength. Further, the number of parts in the bolt assembly has been reduced from eight in the prior art to four in certain embodiments of the present invention. Still further, the high pressure supply chamber has been enlarged compared to the prior art due to the smaller bolt dimensions, while the amount of air necessary to cycle the bolt has been reduced, because the bolt is now smaller. Yet further, a smaller bolt means that the high pressure air propelling the paintball has less room to expand before it reaches the paintball, that is, the pressure drop of the high pressure air due to expansion is reduced, providing greater propulsion force to the paintball.

When the pneumatic paintball marker 10 is fired, the micro switch 126 is pressed by the trigger mechanism 38, telling the solenoid 78 to switch the flow of air from the front of the cylinder 84A to the rear of the cylinder 84B by the means of passing the low-pressure air through the low-pressure air transfer hole 82 into the forward drive air transfer groove 130. This low-pressure air enters "the plurality of forward drive air supply holes 132 in the top hat 112 and into the forward drive air chamber 134. Air that enters the rear of the cylinder 84 will provide a propelling pneumatic pressure on the bolt sail 122, moving the bolt 110 forward. The air in the front of the cylinder 84 is vented back through the solenoid 78.

The high-pressure air coming through the high-pressure air supply passage 62 into the high-pressure transfer passage 68 is also diverted into the bolt recharging chamber 66 and through a plurality of orifices 138 into the high-pressure air supply chamber 124.

As the bolt 110 moves forward, the tapered stem 140 passes through the top hat 112. Once the tapered stem 140 can no longer provide a substantial seal against the o-ring 56, the air contained in the high-pressure air supply chamber 124 is released through the air channel 125. The air passes through the air transfer orifices 142 in the bolt 110 and out the bolt central chamber 144 to the front of the bolt 110 to propel the paintball. When the bolt 110 is in the forward position, o-ring 56 on the rear bolt stem 143 prevents the flow of air from continuously flowing through the pneumatic paintball marker 10 when the bolt 110 is in a forward position. This helps the marker shoot much more efficiently and eliminates any loss of compressed air.

The low-pressure regulator 70 is located in the lower back of the pneumatic paintball marker 10 below the orifice containing the bolt assembly 28A. The function of the low-pressure regulator 70 is to lower the air pressure supplied to the pneumatic paintball marker 10 by the in-line source before it reaches the solenoid 78. Pneumatic paintball marker 10 can be fine-tuned to its minimum cycle pressure, reducing the amount of force of the bolt 110 hitting the paintball, thus reducing paintball breaks within the device due to the strength of the impact and improving efficiency. A pressure that is too low will cause the bolt 110 to not cycle and to move sluggishly or not move at all. A pressure that is too high instead will cause the pneumatic paintball marker 10 not to shoot as smoothly, potentially increasing paintball breakage and causing undue wear and fatigue on the components of bolt assembly 28A. In one embodiment, the low pressure regulator provides for pressure adjustments within a 400-600 kPa range, with 0.7 kPa increments.

The low pressure regulator threaded cap 30 retains the low pressure regulator 70 within the body 16 of the pneumatic paintball marker 10. Turning the adjustment screw 146 in the low pressure regulator 70 clockwise, or in, will lower the output pressure from low-pressure regulator 70. Adjustment screw 146 is located in the rear portion of the pneumatic paintball marker 10, and is accessible through the low pressure regulator threaded cap 30. Alternatively, turning the adjustment screw 146 counter-clockwise, or out, will raise the output pressure of low-pressure regulator 70.

Figure 21:
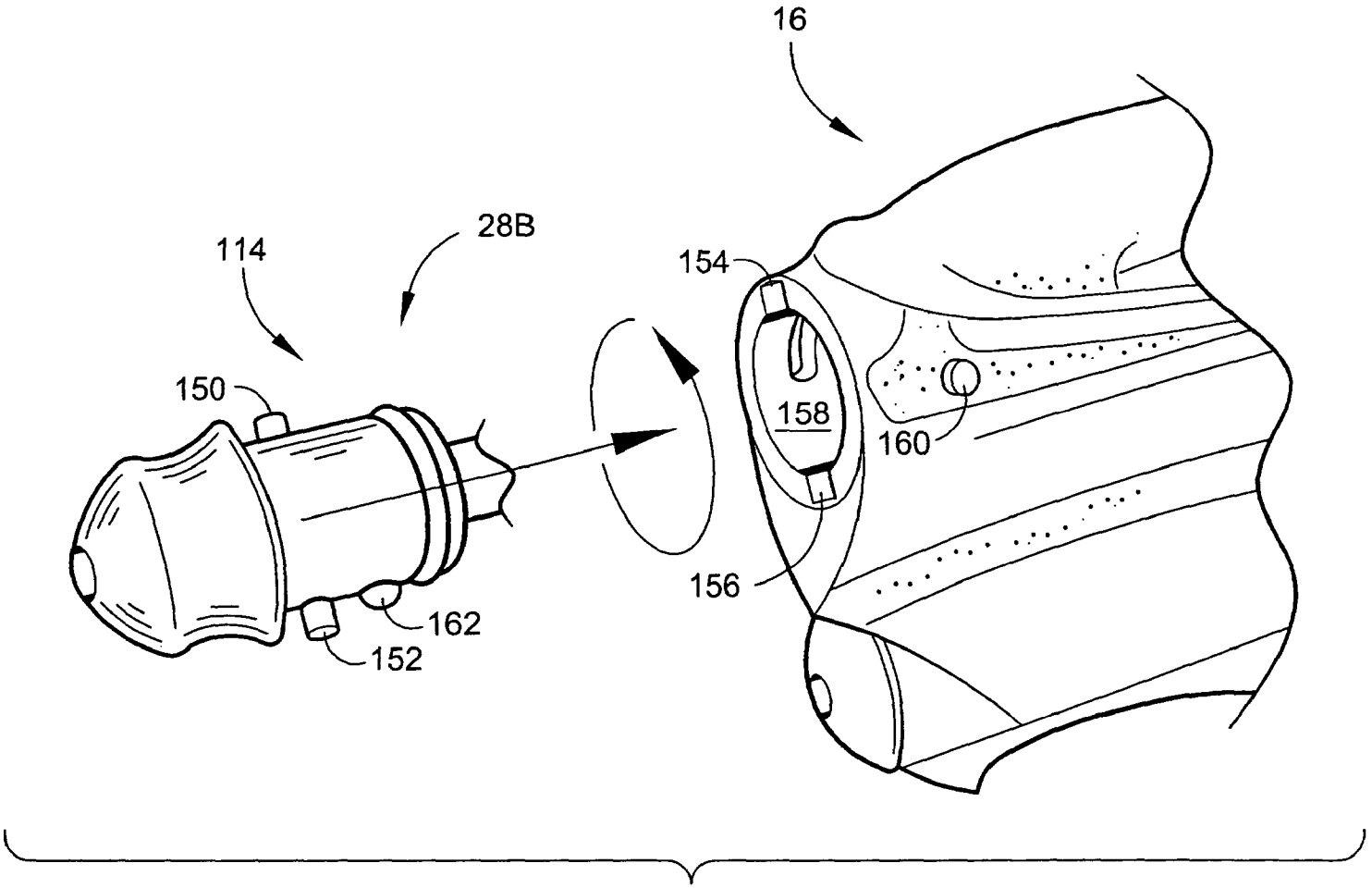
FIG. 21 is a perspective view of an alternate embodiment of the rear cap of the bolt assembly with a quarter-turn locking mechanism combined with a spring-loaded ball detent engagement.

In the illustrated embodiment, the rear cap of the bolt assembly is accessible from the outside of paint ball marker 10 through an opening in body 16, and the bolt assembly has a threaded connection with that opening. Consequently, the bolt assembly can be removed as a single piece by unscrewing the rear cap from the opening. Referring now to FIG. 21, an alternate embodiment on the rear cap 114 of the bolt assembly 28B is shown to incorporate a quick removal system for the bolt assembly 28B. This bolt assembly 28B includes two cogs 150 and 152 for a quarter-turn locking mechanism instead of the threads for locking the bolt 28B within the marker body 16. The two cogs 150 and 152 are then inserted into two matching retainers 154 and 156 at the rear of the marker body 16. The rear cap 114 will also incorporate a spring-loaded ball detent 162 that will drop into a depression (not shown) within the central bore 158 of the marker body 16 with a push button 160 on the outside surface of the marker body 16 to push the ball detent 162 back for removal of the bolt assembly 28B.

An anti-chop eye electronic system that is contained within the circuit board 42 will prevent the pneumatic paintball marker 10 from breaking the paintballs within the device, a phenomenon commonly called chopping paint, by not allowing the pneumatic paintball marker 10 to fire until a paintball is fully seated in a breech in front of the bolt 110. The anti-chop eye system uses a beam across the barrel cavity 166 to identify the paintball location. On one side there is a transmitter eye 164A, and on the opposite side a receiver eye 164B. In order for the marker to fire with the anti-chop eyes turned on, the signal between the two eyes 164A and 164B must be broken. After every shot, before the next paintball drops in the breech, where the paintball is positioned prior to firing, the receiver eye 1643 must recognize the transmitter eye 164A of the anti-chop eyes. If the anti-chop eyes are dirty and cannot see each other between shots, the anti-chop indicator lamp 35 on the circuit board 42 that can be seen through the anti-chop indicator lamp lens 36 in the handgrip frame 14 will start blinking green. This means that the anti-chop eyes are dirty. This system is extremely reliable as long as the anti-chop eyes 164 are kept clean. Rubber ball detents 168 on either side of the barrel cavity 166 retain the paintballs in position between the transmitter eye 164A of the anti-chop eyes 164 and the receiver eye 164B of the anti-chop eyes prior to the firing of the pneumatic paintball marker 10.

In one embodiment, the signal emitted by transmitter eye 164A is modulated by turning it on and off at a predetermined pace, in order to have receiver eye 164B distinguish that signal from other potentially interfering signals, for instance, from sunlight or the color of the paintball. More specifically, transmitter eye 164A may be a light emitting diode ("LED") and receiver eye 164B may be a photo-transistor, and the signal received by the phototransistor may be processed by software resident in the paintball marker. A typical wavelength generated by emitter eye 164A is 940 nm.

The anti-chop eye electronic system may also comprise an error reporting system that alerts the user of a malfunctioning of the anti-chop eye electronic system, thereby enabling the user to bypass that system. A second button may also be positioned next to the on-off button on frame 14, to enable the user to by-pass the anti-chop eye electronic system by pressing that second button. A light signal may also alert the user when the anti-chop eye electronic system is on or off.

The pneumatic paintball marker 10 shown in the drawings and described in detail herein is disclosed as having elements of particular construction and configuration for the purpose of illustrating embodiments of structure and method of operation of the present invention. It is to be understood, however, that elements of different construction and configuration and other arrangements thereof, other than those illustrated and described may be employed for providing a pneumatic paintball marker 10 in accordance with the spirit of this invention, and such changes, alternations and modifications as would occur to those skilled in the art are considered to be within the scope of this invention as broadly defined in the appended claims.

Further, the purpose of the abstract is to enable one skilled in the art, and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

INDUSTRIAL APPLICABILITY

The present invention is applicable in a number of industrial areas, a few of which are:

A. The manufacture of paintball guns for entertainment purposes, a sport that presently counts hundreds of thousands of practitioners worldwide;

B. The manufacture of paintball markers for the forest industry, to mark and identify trees to be cut or to be monitored;

C. The manufactures of paintball markers for the cattle raising industry, in order to mark animals to be retrieved for slaughtering, especially in open range cattle raising, or to be otherwise monitored;

D. Other general industrial applications where an object needs to be marked for later identification rapidly and possibly from a distance.

The invention claimed is:

1. A pneumatic paintball marker configured to fire a paintball, said pneumatic paintball marker comprising:

a body member in the shape of a gun and having a longitudinal bore;

a trigger connected to said body member and configured to move between a firing position and a non-firing position;

a barrel extending from said body member and in flow communication with said longitudinal bore;

a bolt assembly housed in said bore and having a cap, a cylinder, and a bolt, said bolt being configured to translate longitudinally within said cap and said cylinder, said cylinder having forward and rear bolt stops, at least one of said forward and rear bolt stops having an inner surface, at least a portion of said inner surface having a smaller diameter than a portion of said cylinder disposed between said forward and rear bolt stops;

a sail extending radially from said bolt and being configured to hinder gas flow between said bolt and said cylinder;

a pneumatic regulation system configured to provide a first pneumatic pressure on said sail to translate said bolt towards said barrel when said trigger is in said firing position, said pneumatic regulation system further configured to provide a second pneumatic pressure against said sail that hinders said bolt from translating towards said barrel when said trigger is in said non-firing position; and one or more bumpers positioned in the proximity of said sail and between said bolt and said cylinder, said one or more bumpers being sized to enter at least one of said forward and rear bolt stops so as to contact said inner surface and decelerate said bolt by frictional forces between said one or more bumpers and said inner surface, said one or more bumpers preventing a bouncing of said bolt off said cylinder, thereby providing for a smoother operation of said pneumatic paintball marker for optimal flow of compressed gas and for improved paintball speed.

2. The pneumatic paintball marker according to claim 1, wherein said cap is a three-part structure comprising the cylinder, a rear cap positioned opposite to said barrel, and a top hat included between said cylinder and said rear cap.

3. The pneumatic paintball marker according to claim 2, wherein said rear cap is accessible from the outer surface of said body by being positioned in an opening in said body opposite to said barrel.

4. The pneumatic paintball marker according to claim 3, wherein said rear cap further comprises one or more cogs extending from a wall of said rear cap, wherein said opening comprises one or more retainer slots in a matching position to said one or more cogs and shaped to secure said one or more cogs, and wherein said rear cap is fastened to said opening by securing said one or more cogs in said one or more retainer slots.

5. The pneumatic paintball marker according to claim 2, wherein said rear cap further comprises one or more ball detents positioned on a wall of said rear cap.

6. The pneumatic paintball marker according to claim 5, wherein said bore further comprises one or more depressions in matching positions to said one or more ball detents.

7. The pneumatic paintball marker according to claim 2, wherein said compressed gas flows to a supply chamber defined by a portion of the bore wall and at least a portion of said rear cap and of said top hat, wherein said compressed gas is circulated at a reduced pressure by a low pressure regulator to provide said propelling and restraining pneumatic pressures against said sail, wherein said paintball is positioned in a breech in said bore, and wherein the gas in said supply chamber is released into said barrel upon translation of said bolt towards said barrel, thereby propelling said paintball.

8. The pneumatic paintball marker according to claim 7, wherein said pneumatic regulation system comprises a solenoid connected to said trigger and to said low pressure regulator, said solenoid causing said restraining pneumatic pressure to convert to propelling pneumatic pressure upon actuation of said trigger by routing said gas at said reduced pressure from a first portion of said bolt assembly to a second portion of said bolt assembly.

9. The pneumatic paintball marker according to claim 7, wherein said bolt has a longitudinal profile of varying widths, wherein said supply chamber is delimited in the direction of said barrel by a surface comprising a ring extending from said cap towards said bolt to form a substantially sealing contact with a first section of said bolt, wherein the translation of said bolt in the direction of said barrel causes a second section of said bolt with a narrower width than said first section to face said ring, thereby creating a gap, and wherein said compressed gas is released from said supply chamber into said barrel by flow through said gap.

10. The pneumatic paintball marker according to claim 1, wherein the supply of said compressed gas is governed by an in-line pressure regulator.

11. A pneumatic paintball marker configured to fire a paintball, said pneumatic paintball marker comprising:

a body member having a longitudinal bore;

a barrel extending from said body member and in flow communication with said longitudinal bore;

a bolt assembly housed in said bore and having a bolt and a cylinder, said bolt being configured to translate longitudinally within at least a portion of said cylinder, said cylinder having forward and rear bolt stops, at least one of said forward and rear bolt stops having an inner surface, at least a portion of said inner surface having a smaller diameter than a portion of said cylinder disposed between said forward and rear bolt stops;

a sail extending radially from said bolt and being configured to hinder gas flow between said bolt and said cylinder;

a pneumatic regulation system configured to provide a first pneumatic pressure on said sail to translate said bolt towards said barrel, said pneumatic regulation system further configured to provide a second pneumatic pressure against said sail that hinders said bolt from translating towards said barrel; and one or more bumpers positioned in the proximity of said sail and between said bolt and said cylinder, said one or more bumpers being sized to enter at least one of said forward and rear bolt stops so as to contact said inner surface and decelerate said bolt by frictional forces between said one or more bumpers and said inner surface so as to prevent said bolt from bouncing off said cylinder.

12. The pneumatic paintball marker according to claim 11 further comprising a trigger connected to said body member and configured to move between a firing position and a non-firing position.

13. The pneumatic paintball marker according to claim 11, wherein said pneumatic regulation system circulates compressed gas at a reduced pressure to propel and restrain pneumatic pressures against said sail.

14. The pneumatic paintball marker according to claim 13, wherein said paintball is positioned in a breech in said bore, and wherein the gas is released into said barrel upon translation of said bolt towards said barrel, thereby propelling said paintball.

15. A pneumatic paintball marker configured to fire a paintball, said pneumatic paintball marker comprising:

a body member having a longitudinal bore;

a bolt assembly housed in said bore and having a bolt and a cylinder, said bolt being configured to translate longitudinally within at least a portion of said cylinder, said cylinder having forward and rear bolt stops, at least one of said forward and rear bolt stops having an inner surface, at least a portion of said inner surface having a smaller diameter than a portion of said cylinder disposed between said forward and rear bolt stops;

a sail extending radially from said bolt and being configured to hinder gas flow between said bolt and said cylinder; and one or more bumpers positioned in the proximity of said sail and between said bolt and said cylinder, said one or more bumpers being sized to enter at least one of said forward and rear bolt stops so as to contact said inner surface and decelerate said bolt by frictional forces between said one or more bumpers and said inner surface so as to prevent said bolt from bouncing off said cylinder.

16. The pneumatic paintball marker according to claim 15 further comprising a trigger connected to said body member and configured to move between a firing position and a non-firing position.

17. The pneumatic paintball marker according to claim 16 further comprising a pneumatic regulation system configured to provide a first pneumatic pressure on said sail to translate said bolt towards said barrel when said trigger is in said firing position, said pneumatic regulation system further configured to provide a second pneumatic pressure against said sail that hinders said bolt from translating towards said barrel when said trigger is in said non-firing position.

18. The pneumatic paintball marker according to claim 17 further comprising a control valve activating and interrupting the supply of pneumatic pressure to said paintball marker.

19. The pneumatic paintball marker according to claim 15, wherein said bolt assembly further comprises a cap, said bolt being configured to translate longitudinally within said cap.

20. The pneumatic paintball marker according to claim 19, wherein said cap is a three-part structure comprising the cylinder, a rear cap positioned opposite to said barrel, and a top hat included between said cylinder and said rear cap.

* * * * *